US006339193B1

(12) United States Patent
Goett et al.

(10) Patent No.: US 6,339,193 B1
(45) **Date of Patent: *Jan. 15, 2002**

(54) MULTIPLE INTERNAL SHIELD TERMINATION SYSTEM

(75) Inventors: Edward P. Goett, Geyserville; Roger Woehl, Rohnert Park, both of CA (US); Robert F. Spratt, Faringdon (GB)

(73) Assignee: Engineered Transition Company, Inc., Santa Rosa, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/038,701

(22) Filed: Mar. 9, 1998

Related U.S. Application Data

(63) Continuation-in-part of application No. 08/852,372, filed on Apr. 1, 1997, now abandoned, and a continuation of application No. 08/377,434, filed on Jan. 24, 1995, now abandoned.

(51) Int. Cl.[7] ..... H01R 9/03
(52) U.S. Cl. ..... 174/78; 439/610
(58) Field of Search ..... 174/78, 74 R, 174/84 R, 88 C; 439/98, 99, 610; 29/862, 871, 516, 517, 518

(56) References Cited

U.S. PATENT DOCUMENTS

| | | | | | |
|---|---|---|---|---|---|
| 3,622,952 | A | | 11/1971 | Hilbert | 339/177 R |
| 3,944,317 | A | | 3/1976 | Oberdiear | 339/143 R |
| 3,990,765 | A | * | 11/1976 | Hill | 439/610 |
| 4,113,981 | A | | 9/1978 | Fujita et al. | 174/88 R |
| 4,352,714 | A | | 10/1982 | Patterson et al. | 156/626 |
| 4,382,653 | A | * | 5/1983 | Blanchard | 439/610 X |
| 4,558,918 | A | | 12/1985 | Shores | 339/143 R |
| 4,820,201 | A | | 4/1989 | Van Brunt et al. | 439/610 |
| 4,921,449 | A | * | 5/1990 | Fish | 439/610 |
| 5,032,089 | A | | 7/1991 | Hansell, III | 439/609 |
| 5,052,947 | A | | 10/1991 | Brodie et al. | 439/607 |
| 5,102,351 | A | | 4/1992 | Meshel | 439/607 |
| 5,183,417 | A | | 2/1993 | Bools | 439/610 |
| 5,558,539 | A | * | 9/1996 | Lignelet | 439/610 |

* cited by examiner

*Primary Examiner*—Chau N. Nguyen
(74) *Attorney, Agent, or Firm*—Johnson & Stainbrook, LLP; Larry D. Johnson; Craig M. Stainbrook

(57) ABSTRACT

A conductive yoke is provided insertable into a backshell adapter to provide a convenient shielding termination system for grounding braids and shields of conductors in a multiconductor cable to be connected to and grounded at a multipin electrical connector, the yoke providing ease of connection of such braids and shields to it and having direct electrical contact to the grounded surface of the connector.

9 Claims, 6 Drawing Sheets

165
166
168
170
172
174
176
178
180
182
184
186
188
190
192
194
12

MULTIPLE INTERNAL SHIELD TERMINATION SYSTEM

CROSS-REFERENCE TO RELATED APPLICATIONS

This application is a continuation-in-part of application Ser. No. 08/852,372 filed Apr. 1, 1997 now abandoned, which is a continuation of application No. 08/377,434 filed Jan. 24, 1995 now abandoned.

FIELD OF THE INVENTION

The present invention relates to electrical grounding of shielded cables and wires to a connector housing, and more particularly to an improved backshell adapter with an easily removable interface yoke suitable for attaching cable shields and grounding leads through a low resistance path directly to the connector housing.

BACKGROUND OF THE INVENTION

Electrical connectors coupled to a cable by way of a backshell adapter provide reliable means for attaching a cable to an electrical component. The backshell adapter secures the cable to the connector while the connector provides a releasable means for transmitting the cable signals across a junction. This arrangement is of particular value for sophisticated electronics equipment requiring multiple wires transmitting signals and power to external components. Such equipment is often found in aircraft, satellites, military vehicles, electronically controlled machinery, and similar equipment.

Wires in the cables of sensitive electronic equipment are susceptible to interference from electrical and magnetic sources both internal and external to a cable. As a means of shielding wires from such interference a braided metal sleeve or shield is often placed over individual wire, pairs of wires, and/or, and entire bundle of wires comprising a cable. The shield protects wires of the cable from electromagnetic interference (EMI) as long as they are suitably grounded and shielded at the ends of the cable. For cables attached to connectors, the metal housing of the connector provides the path to ground; the means for electrically grounding the wire shields to the housing being the subject of this disclosure.

Where used, a backshell adapter serves a variety of functions to mechanically and electrically transition the cable and wires to the connector. In the region just behind the connector, wires must be stripped and prepared for insertion into the connector. Sufficient wire must be stored to allow future repair access to connector pins, and grounding of external wire shields must be accommodated. The wires must be mechanically secured to the connector. Backshells provide an enclosed housing and mechanisms to support these functions.

The backshells are typically coupled to the connector by way of a mating interface with a threaded coupling that can be removed as needed for repair. The interface configuration and dimensions are supported by military and industrial standards to insure interchangability between components from different manufacturers. The interfaces are designed to insure reliable mechanical, environmental and electrical coupling. Electrically the interface must insure solid grounding and electrical and magnetic shielding with no windows for EMI leakage. Environmentally the backshell-to-connector interface must be sealed from external hazards such as corrosion inducing moisture. Mechanically the interface must maintain the electrical and environmental functions under tensile, bending and torsion loading, in addition to shock and vibration.

Connector and cable designs are available with a wide range of performance capabilities. Increasing performance comes with increased cost. Backshell adapters are typically chosen as a means of transitioning cables to connectors when the system cost favors repair over replacement for damaged assemblies. Backshell adapters are advantageous because they are designed to optimally transition a wide variety of cable configurations to a relatively few number of standard connector designs. This maintains connector cost lower by enabling a few designs to be produced in higher quantity. The backshell separates the transitional requirements from the electrical connection requirements, allowing each to be separately optimized for cost and performance.

DESCRIPTION OF THE PRIOR ART

There are several common methods used to terminate a wire shield to a connector. These methods including utilizing pigtails, jumpers, or grounding leads to create a ground path to a point on the backshell, or to a pin within the connector. These methods are time consuming to install or repair and are generally hampered by the lack of access to the wires within the backshell. In many instances, there is no adequate means within the structure to attach the ground leads to the backshell so as to be close to the mating connector interface. Leads are often secured at the rear of the backshell hardware, increasing the resistance of the ground path. Further, these methods rely on the conductivity of the backshell and are unsuitable for applications requiring a low conductivity, or non-conductive backshell material; examples include lightweight plastics or corrosion resistance stainless steel, not good conductors or shields. If the attachment of leads takes place outside of the protective backshell housing, then the termination is vulnerable to corrosion damage.

Methods using pigtails or ground leads often attach the leads at the point of mechanical coupling of the backshell to the cable. These methods require the ground leads to be disconnected every time the backshell is loosened to give access to the connector.

One method, for terminating shielded wires to a connector is presented by Van Brunt et al, U.S. Pat. No. 4,820,201. This method extensively modifies a standard connector to include a metal disk suitable for attaching wire shields by means of a transition clip secured over the shielded braid. The metal disk includes multiple openings arranged to coincide with the wire entry points commonly used on connectors. While providing a very short ground path for shields, this method requires an expensive connector modification, precluding the use of standard off the shelf connector configurations. Further each type of connector can have many insert arrangements, each with a different hole pattern. This arrangement requires a specific grounding disk be used for each insert arrangement, making the system prohibitively expensive for most applications.

Traditional ground leads methods have proven to be inadequate for simple effective grounding of shields. Further, methods that require extensive modification of connectors designs have been found to be prohibitively expensive. There exists a need for a cost effective method of grounding shields that insures a low resistance path to ground, and a reliable well protected termination that is both easy to install and repair.

BRIEF DESCRIPTION OF THE PRESENT INVENTION

The present invention provides for an improved backshell adapter and yoke configuration that readily accommodates the termination of ground leads secured to the braids of shielded wires and cables. In particular, it provides for a conductive removable connector interface with an attached means for terminating ground leads, said removable interface being referred to here as a yoke. The yoke is removably insertable into the front of a backshell designed to accept it. When the backshell is mated to a connector, the yoke mates directly to the connector interface providing a low resistance ground path to the connector housing for any lead, particularly ground braids, secured directly to the yoke.

The removable yoke provides many benefits to the user. First, it is a secured grounding platform for shield leads residing in close proximity to the connector housing. Multiple wire leads can be attached to the yoke, by any number of methods that are common in the industry, such methods including banding, soldering, or clipping to name a few. Second, the yoke provides ample access to the lead terminations during installation and repair. The ease of access to shield leads reduces the cost of terminating a cable to a connector. Third, the yoke allows the backshell to be removed from the connector to gain repair access to the wires without having to disconnect the grounding shield. This arrangement results in substantial time saving during repair or inspection, and eliminates one of the leading causes of cable problems; namely, failure to properly reground shield leads after decoupling a backshell.

As the connector interface for the backshell, the yoke must accommodate all of the mechanical, electrical and environmental interface requirements without adversely interfering with the form, fit or function of the connector. Further, to remain a viable design option, the yoke must conform to the dimensional limits of standardized connector and backshell specifications. As a final consideration, the yoke and mating backshell must be cost effective and must be capable of production by standard methods. All of these requirements dictate a very narrow envelope in which a yoke may be designed. Some connector interfaces do not permit a removable yoke owing to a conflict between two or more of the above requirements. The most commonly used circular connectors, however, including those governed by the military standards MIL-C-38999 and MIL-C-85049, enable a yoke design.

The yoke is a generally circular member having a maximum external diameter and a minimum internal diameter, both diameters set by the yoke's functional requirements. Within the maximum and minimum envelope, the yoke design must accommodate ground lead termination, adapter body grounding, environmental sealing, anti-body rotation, and EMI shielding, as well as electrical field shielding. The maximum outside diameter of a removable yoke is limited by the minor dimension of the female threads on a coupling through which the yoke must be passed for removal. The minimum inside diameter is limited in some regions by the interface design standards, and in others the need to insert wires into the prearranged hole patterns of a connector insert. For each size connector, there is a minimum diameter needed to accommodate the largest possible wire configuration supported by the connector inserts. If the yoke ID is below the limit, it will not be functionally suitable for the connector.

Ideally, a connector and backshell interface would be designed with the needs of a removable yoke in mind. However, one of the important objects of the yoke is that it can function with the common connector interfaces that already enjoy an extensive installed user base.

One important feature of the yoke is that it can be made from a material different from the backshell adapter. The backshell can be constructed of a material best suited for its application, strength and adaptability to existing connectors while the yoke may be constructed of a conductive material best suited for grounding shield leads and providing electrical field and EMI shielding. In corrosive environments, such as marine atmospheres, a backshell body can be made of corrosion resistant stainless steel, while the yoke can be made of a much more conductive metal. Because the yoke is housed within the adapter, it will not see the harsh environment.

Yet another application for a yoke of dissimilar material is in the lightweight adapters for aircraft. A plastic body, possibly plated with a thin metal EMI coating, can be used for a lightweight adapter body. The yoke, being relatively small, can also be made of metal. In such an application, the heavier metal material is used only where needed for secure grounding.

The yoke is ideal for backshell adapters terminated to a flexible conduit. In such applications, a conduit with a pre-attached backshell is supplied to customers for wiring. In such instances, ground leads cannot be integrated with the adapter termination, leaving no effective means for grounding shield leads. The yoke provides a grounding platform, with all the advantages previously mentioned.

Many backshells are designed to secure a wire bundle by a mechanical strain relief structure that when loosened allows the adapter to slide down the cable giving ample repair access to the back of the connector. When a cable has internal shield terminations that are secured to the backshell, they must be disconnected before the adapter can be slid down the cable. When the yoke is used to terminate the ground leads, the adapter can be slid back down the cable while the shield leads stay securely terminated to the yoke. As the backshell adapter is slid down the cable, the yoke exists the front of the connector.

Another feature of the yoke is that it can be supplied with grounding leads pre-attached. When installed the leads can be grounded to a wire braid by a suitable solder method, several of which are common in the industry as a means for attaching leads to braid sleeves.

In addition to securing individual shield leads, the yoke can be used to ground the bulk shield of a cable. The bulk shield can be passed through the center of the adapter and secured circumferentially around the yoke termination area by one of several means, including a band, crimp or solder. This method has the advantage of allowing the yoke to provide EMI shielding right up to the back of the connector. Further, when decoupled from the connector, the backshell can be slid down the cable to give access to the back of the connector without having to disconnect the yoke. This feature is a significant advantage for repair.

OBJECTS OF THE INVENTION

It is an object of the present invention to provide a shield termination system that can be used with standard connectors.

It is an object of the present invention to provide a shield termination system that maintains a low resistance path to ground.

It is an object of the present invention to provide a shield termination system that protects terminations from the environments.

It is an object of the present invention to provide a shield termination system that allows repair access to the connector without disturbing the shield ground leads.

It is an object of the present invention to provide a shield termination system that allows the shields to be pulled clear of the backshell to provide working room for installation and repair.

It is an object of the present invention to provide a shield termination system that is lightweight.

It is an object of the present invention to provide a shield termination system that is resistant to the effects of vibration.

It is an object of the present invention to provide a low resistance shield termination system that allows a backshell to be constructed of less conductive material than previously while still providing electrical field and EMI shielding.

It is an object of the present invention to provide a shield termination system that will provide strain relief to individual wires.

It is an object of the present invention to provide a shield termination system capable of grounding a bulk cable braid.

It is an object of the present invention to provide a shield termination system that conforms to dimensional and performance requirements of industry standards for backshell interfaces.

The above and other features, objects and advantages of the present invention, together with the best means contemplated by the inventors thereof for carrying out the invention will become more apparent from reading the following description of a preferred embodiment and perusing the associated drawings in which:

DETAILED DESCRIPTION OF THE INVENTION

Figure 1:
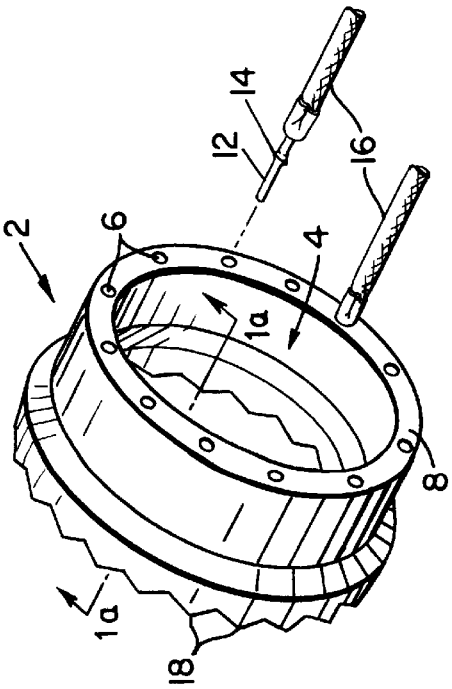
FIGS. 1 and 1*a* illustrate one version of the yoke of the present invention.
Figure 1A:
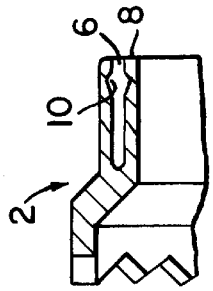

Referring now specifically to FIG. 1 of the present invention, there is illustrated one form of yoke of the invention generally designated by the reference numeral 2. The yoke is an annulus having a large center opening 4 and in this configuration a plurality of apertures 6 formed in a rear wall 8 of the yoke 2; the wall 8 being transverse to the axis of the annulus. The apertures 8 have indents (or notches) 10 that cooperate with ridge 12 on pins 14 secured to the ends of conductors 16 to be terminated in (grounded at) the yoke 2. The conductors 16 are the braids of the individual cable conductors and the grounding wires for the cable braid.

Figure 6:
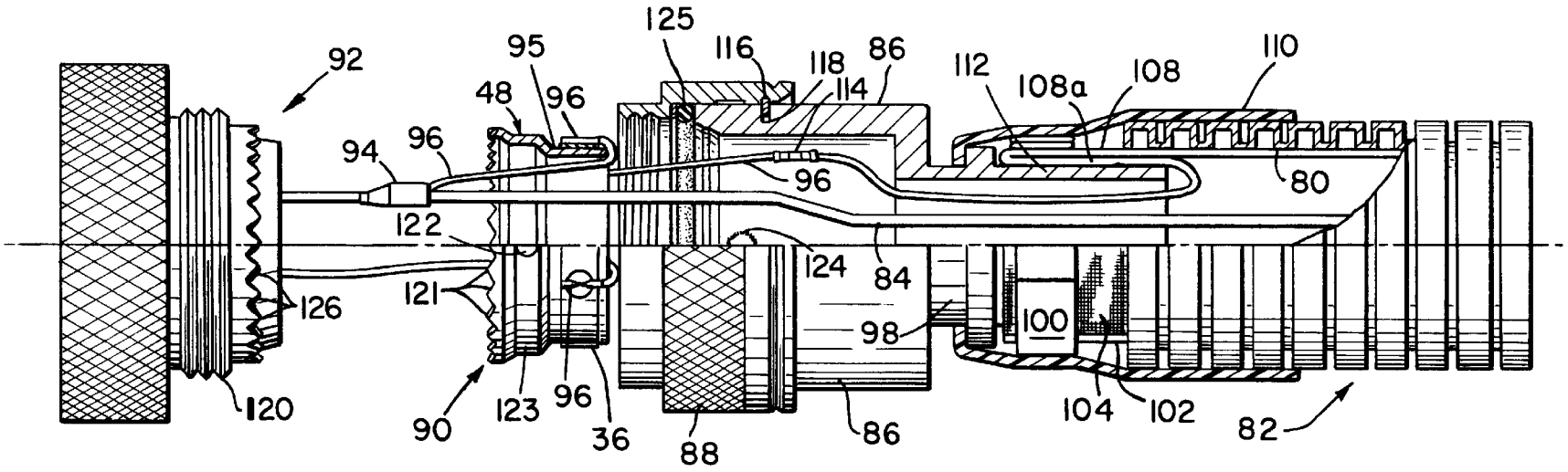
FIG. 6 illustrates the assembled cable and termination structure partially in section.

The front of the yoke 2 has teeth 18 to engage teeth conventionally found on the back of a multipin connector, see FIG. 6 teeth 126.

The yoke may be a lightweight metal such as aluminum, a lightweight plastic with metalized coating or a lightweight plastic with metallic inserts to provide continuity from the grounding leads to a connector.

Figure 2A:
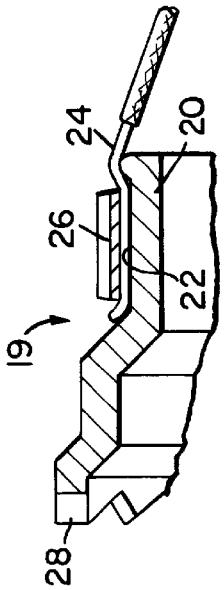
FIGS. 2 and 2*a* illustrate another version of the yoke of the present invention.
Figure 2:
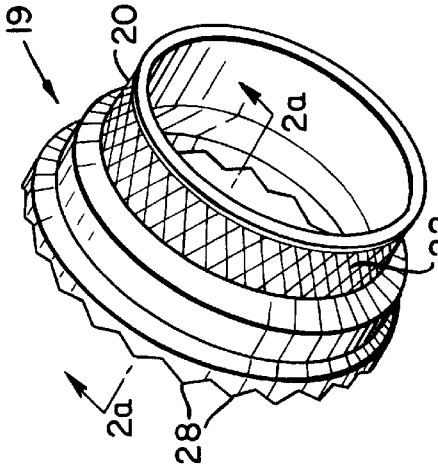

Referring now to FIG. 2 of the accompanying drawings, a yoke 19 has a skirt 20 at its back end; the skirt 20 having a knurled surface 22. Ground leads such as a lead 24, may be clamped to the skirt 20 by a strap 26, preferably but not necessarily conductive. The yoke 19 has teeth 28 as does the yoke of FIG. 1.

Figure 3:
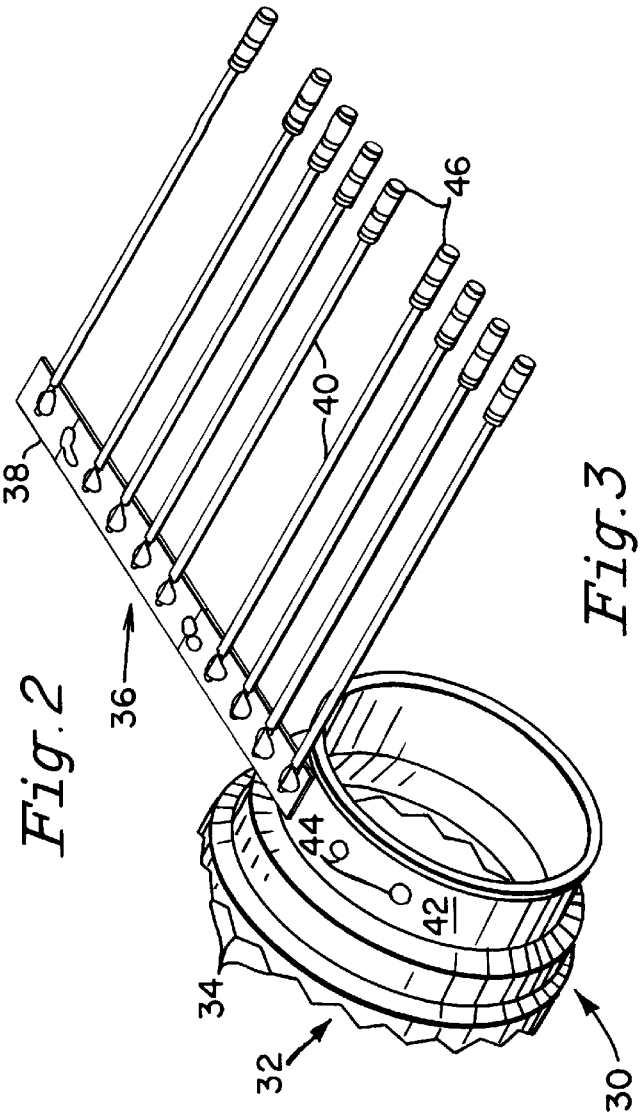
FIG. 3 illustrates a third version of a termination yoke employed with a bandolier grounding tape.

Referring specifically to FIG. 3 of the accompanying drawings, a termination yoke 30 is also in the form of a ring having a toothed front face 32 adapted to interface with an electrical connector (FIG. 6) in conventional fashion. The face 32 has teeth 34 to provide good electrical contact with an electrical connector.

A grounding lead bandolier 36 (hereinafter "tape 36") constitutes a flexible metal band 38 to which is soldered a plurality of wire leads 40 to be employed to ground various components of the assembly. The tape 36 may be made up in any convenient length and may be cut to provide the number of leads required for a particular application. The tape is wrapped around and may be soldered or strapped to a rearwardly located circular region or ring 42 of the yoke 30. The ring may have protrusions 44 thereon to insure firm contact between the ring and the tape. The grounding leads are illustrated as having Solder Sleeves® 46 or the like, connected to their ends remote from the ring 42. (Solder Sleeves is a registered trademark of Raychem Corporation.)

Figure 4A:
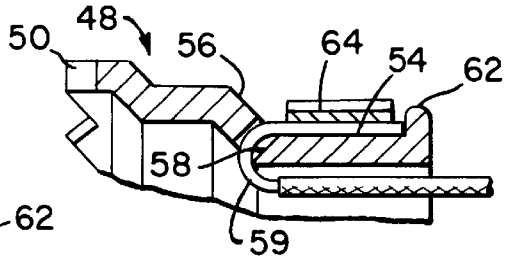
FIGS. 4 and 4*a* illustrate still another version of the yoke of the present invention.
Figure 4:
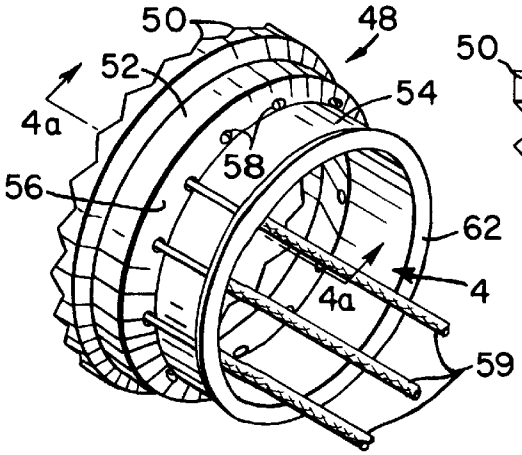

Referring now to FIG. 4 of the accompanying drawings, a yoke 48 has teeth 50 at its front end formed on an annular shoulder 52. The interface between a region 54 of reduced diameter of the yoke and the shoulder 52 defines a sloping wall 56 between the outer perimeter of the shoulder 52 and the region 54. A plurality of holes 58 extend through the shoulder 52 below the teeth 50 from the front of the yoke through to the region 54. Leads 59 to be terminated in the yoke 48 are passed through a large passage 60 through the main body of the yoke and are then reversed and inserted into and through the holes 58 and preferably into contact with an annular shoulder 62 at the back of the region 54. The leads 59 may be clamped against the surface of the region 54 by a strap 64.

Figure 5:
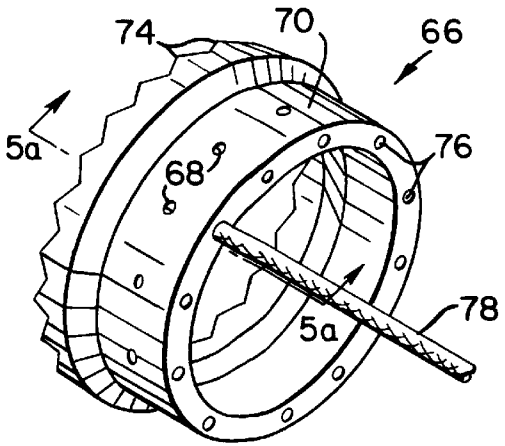

Referring now to FIG. 5 of the accompanying drawings, a yoke 66 is quite similar to the yoke of FIG. 1 with the exception of a ring of holes 68 about annular skirt 70 behind an outwardly sloping region 72 of the yoke. On the front of the yoke teeth 74 are formed for engagement with mating teeth on the back of an electrical connector to be engaged by the yoke.

The yoke has a further ring of holes 76 into which ground leads, such as lead 78, are to be inserted. The holes 68 and 76 intersect for several reasons, first a technician assembling the device can determine if the end of the lead is fully inserted into its hole 76 and secondly, if desired, a length of solder wire may be inserted into hole 68 and heated to solder the wire in place. Alternatively, a short length of solder wire may be inserted into a hole 76, melted and then lead 78 inserted until viewed through hole 68. Heavily tinned wires may also be used as well as a conductive mastic.

Referring now to FIG. 6 of the accompanying drawings an assembled structure incorporating an electric cable backshell adapter, yoke and electrical connector is illustrated. A cable 80 is disposed in a conduit 82 and is included in FIG. 6 to demonstrate the full capability of the yoke. The cable 80 has shielded wires 84 extending from the cable through a backshell adapter 86, thence through an adapter coupling nut 88, and a yoke 90 to the back of a conventional cable connector 92. Outer shields (braids) (not illustrated) of the wires 84 are connected by Solder Sleeves 94 to ground leads 96 connected to surface 95 of the yoke 90, for instance, by the bandolier of FIG. 4, reference numeral 36. The cable and conduit are secured to a reduced diameter region 98 of the adapter 86 by a termination strap 100 that clamps strain relief filaments 102 of the cable, a metal cloth shielding braid 104, and grounding drain wires 108 of the conduit to the region 98 of the adapter 86. The interface between the conduit 82 and adapter body 86 is covered by a heat shrink sleeve 110 to protect against the environment.

The adapter 86 may be a plastic having a metallized coating to provide shielding in its region but does not provide a grounding function. The grounding of the braid 104 and drain wires 108 are affected by folding the drain wires back on themselves (see length 108*a*), clamping them to the adapter 86 on an annulus 112, formed on the back thereof, by the strap 100 and bringing the wire 108 out from under the termination strap and to a Solder Sleeve 114 to one of the grounding leads 96. Thus there is complete continuity from the metal cloth shield 104, braids of the leads 84, and drain wires (strain relief wires) 108 to surface 95 of the yoke, the yoke in turn being grounded via the connector body 92 to system ground.

Referring now to adapter 86, coupling nut 88, is secured to the adapter 86 by a snap ring 116 recessed in a circular slot 118 in the outer surface of the adapter. The yoke 90, when the system is assembled, is seated in the adapter 86 with its surface 117 in engagement with the surface 119 of the adapter, whereby teeth 121 of the yoke can engage teeth 123 (if provided) of the connector 92. The left region of the adapter coupling nut 88 as viewed in FIG. 6, is threaded to mate with threads 120 on the connector 92. The yoke 90 has a radial hole 122 formed in its surface 123 which hole mates with a pin 124 (only half being shown in FIG. 6, see FIG. 7) to retain the yoke in the adapter. The slot and pin arrangement is oriented to not be dislodged by rotation of adapter coupling nut 88.

All regions at the interface between the conduit and electrical connector are fully electrically shielded and are environmentally sealed by an O-ring 125 as well as by sleeve 110. The materials employed throughout are lightweight such as aluminum or plated plastics. As a result of light weight and positive coupling the structure is resistant to shock and vibration while the environmental shielding reduces corrosion and choice of materials reduces effects of heat. EMI protection is provided as indicated above. In the event the back of the electrical connector does not have teeth the yoke may have teeth or may have a flat surface providing high pressure contact between the yoke and connector. The yoke surface may be roughened for better contact.

Figure 7:
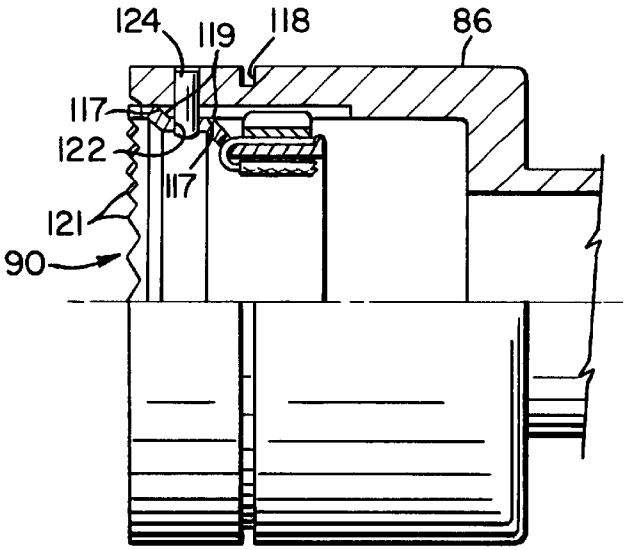
FIG. 7 is a detailed view of one structure for retaining the yoke in the backshell adapter.
Figure 5A:
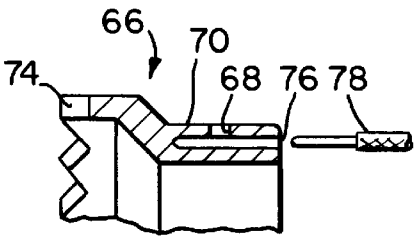
FIGS. 5 and 5*a* illustrate still another construction of the yoke.

Referring to FIG. 7 of the accompanying drawings, the same reference numerals are used as in FIG. 6. The yoke 90 is illustrated as inserted into the end of the adapter 86. To secure the yoke in the adapter 86 the slot 122 is aligned with the pin 124 and the pin is depressed so as to enter slot 122. The yoke is now fixed in place and provides, when the nut 88 is screwed onto threads 120 of the adapter 92, direct engagement with teeth 126 of the connector, thus providing continuity of the grounding path.

An additional feature of the invention is the ease of repair of the assembly. The only element that would normally require replacement in the event of major repair would be the heat shrink sleeve 41 although some of the Solder Sleeves might require replacement. The termination strap may be a standard cable tie and can be readily replaced if necessary.

Figure 8:
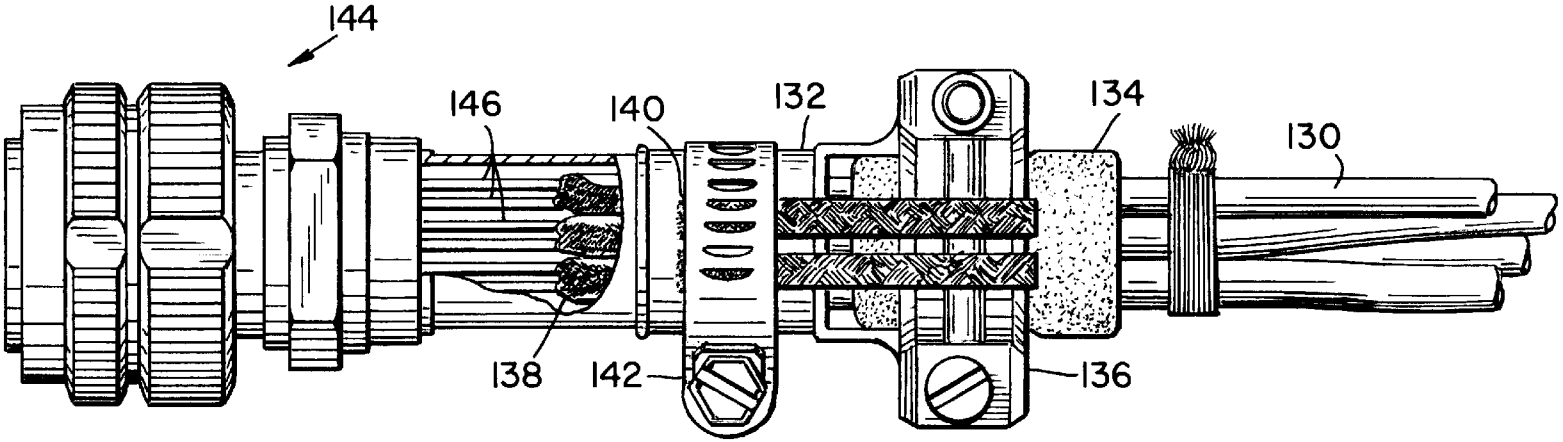
Fig. 8 PRIOR ART
FIG. 8 is a partially cut-away side view of a prior art cable using a saddle clamp to provide strain relief.

Referring now specifically to FIG. 8 of the accompanying drawings, a prior art cable termination system is illustrated. As illustrated four Teflon coated cables 130 enter a backshell connector 132 through a rubber or the like collar 134. A saddle clamp 136 tightly binds the collar 134 about cables 130 to prevent movement of the cables relative to the backshell connector 132. The outer braids 138 of the individual cables 130 are brought out of the ends of the cables 130, looped back over the saddle clamp 136 and secured to an annular area 140 of the backshell connector to the left, of the clamp 136, as viewed in FIG. 8. The braids 138 are secured to the area 140 by, in this instance, a hose clamp 142.

The backshell connector is secured to a multipin electrical connector 144 in conventional fashion. Wires 146 of the cables 130 are connected to the multipin connector 144 as can be seen in the breakaway region of the backshell connector.

The problem with this arrangement resides in the fact that with such a cable, high vibration can cause the cables 130 to pull back away from the electrical connector 144 and place a strain on the wires 146. The braids 138 are of no help in preventing strain on the wires 146 since when the cable pulls back the strain on the braids is reduced. This feature results from the fact that the exit of the braids from the cable are forward of the clamp 136 and are loosened as the cable retreats. Thus strain is placed on the individual wires 146 and can cause failure of one or more wires.

Figure 9:
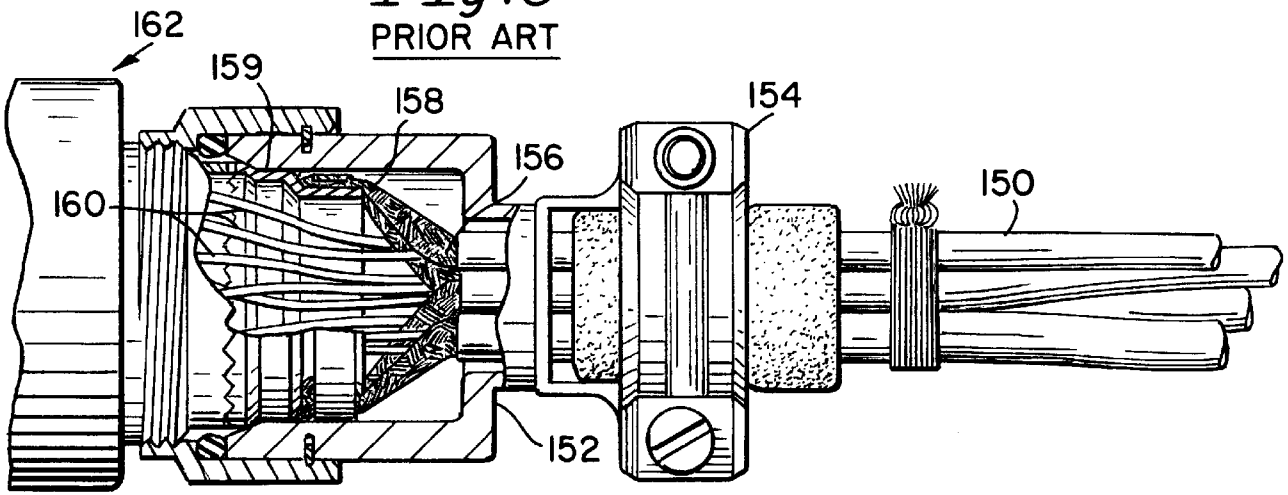
FIG. 9 is a sectional view of a structure for relieving strain on the individual wires of a cable.

Referring now specifically to FIG. 9 of the accompanying drawings, there is illustrated a system for transferring strain on the wires; that is, conductors, to the braids all of which would have to fail before strain is placed on the conductors.

Cables 150 enter a backshell connector 152 through a saddle or like clamp 154. The cables have braided shields 156 that are removed from the cables and formed into pigtails 158. The pigtails are attached to a yoke 159 while conductors 160 of the cables are connected to a multipin electrical connector 162. Note that the conductors 160 are illustrated as being wavy to indicate that they are slack while the braids are straight to indicate they are taut.

Each cable 150 has its braid pigtailed and attached to the yoke. Thus as a practical matter all braids would have to break or become unsoldered before strain is placed on any of the leads. Since the braids are stronger than the conductors the potential for damage to the conductors is greatly reduced.

Figures 10, 11, 12, 13:
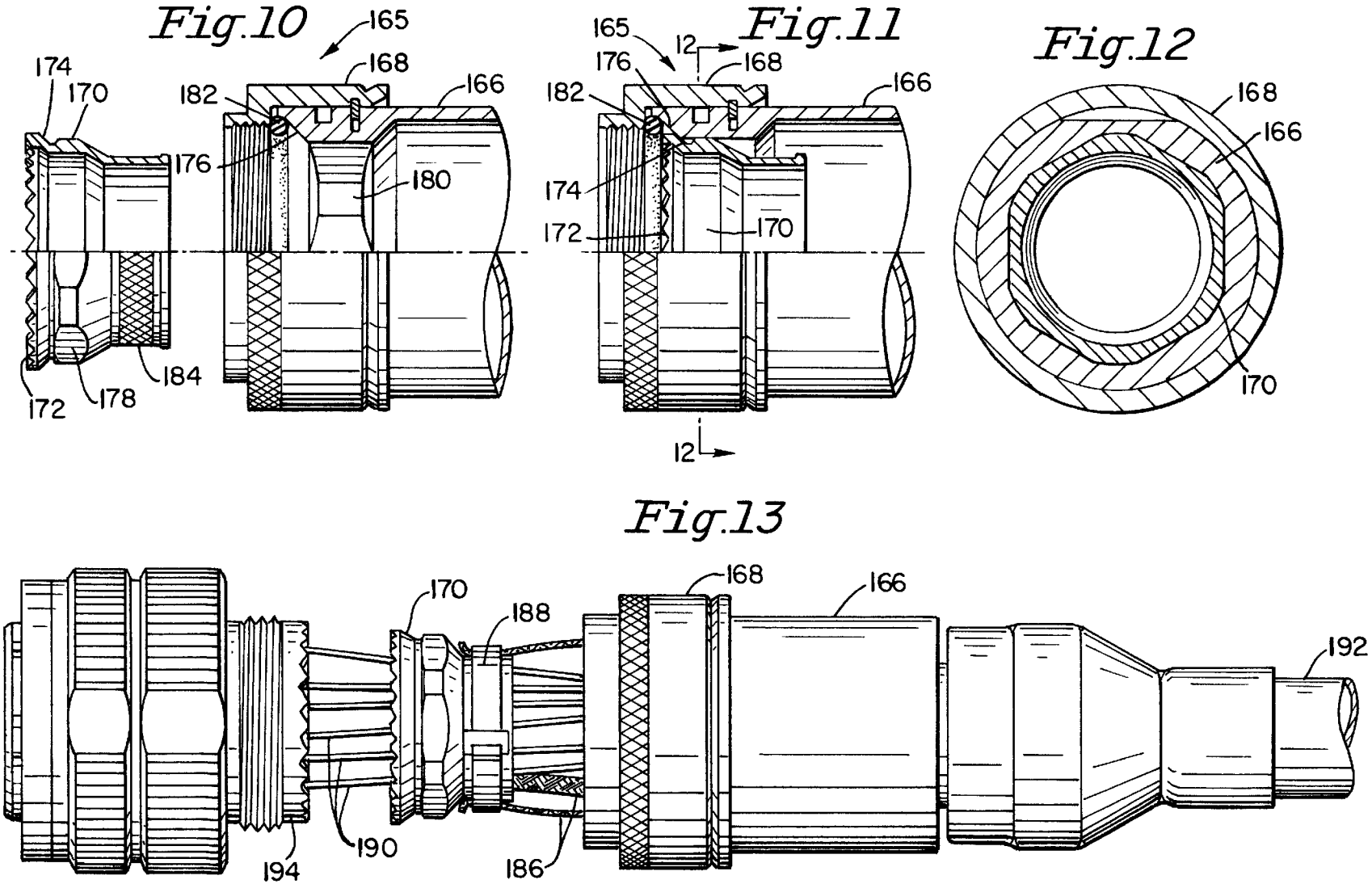
FIG. 10 illustrates the forward section of the backshell connector and yoke of the preferred embodiment of the present invention with the yoke out of the backshell.
FIG. 11 illustrates the structure of FIG. 10 with the yoke nested in the backshell.
FIG. 12 illustrates an end view of the assembly yoke and backshell.
FIG. 13 illustrates an assembly of a multipin electrical connector, a yoke and a backshell connected with the components as they appear after electrical connections are made but before the members are assembled.

A preferred embodiment of the present invention is particularly suitable for mating to a connector of the type specified by the military connector specification MIL-C-38999. FIGS. 10, 11 and 12 show a backshell adapter assembly 165 comprising a body 166, a coupling 168 and a yoke 170. The forward end of the adapter assembly 164 with which we are concerned is shown in FIGS. 10 and 11 where the portion not shown is a cable termination of the type common to backshell adapters. The yoke 170 is shown removed in FIG. 10 and inserted in FIG. 11. The yoke 170 is an annulus, having at its front end teeth 172 suitable for mating with the teeth of an appropriate connector. A rearward facing yoke shoulder 174 connects a forward facing body shoulder 176 so as to hold the yoke forwardly positioned. A plurality of flat sections 178 on the yoke 170 cooperate with mating flat sections 180 on the body 166, as can best be viewed in FIG. 10. The flat sections 178 and 180 prevent the relative rotation of the two members about their axes. An O-ring 182 is seated in the body 166 so as to form a seal with a surface 185 on a mated connector. The O-ring seal insures the yoke 120 interface is protected from the environment. The rearward collar 183 of the yoke forms a region for securing wire ground leads. A roughened surface 184 helps insure solid electrical contact.

As illustrated particularly in FIG. 13, grounding braids 186 of the individual conductors of the cable may be clamped by strap 188 to the region 184 of the yoke thus providing grounding of these braids when the yoke is grounded. Conductors 190 of a cable 192 pass through the yoke to a multipin connector 194.

Figure 14:
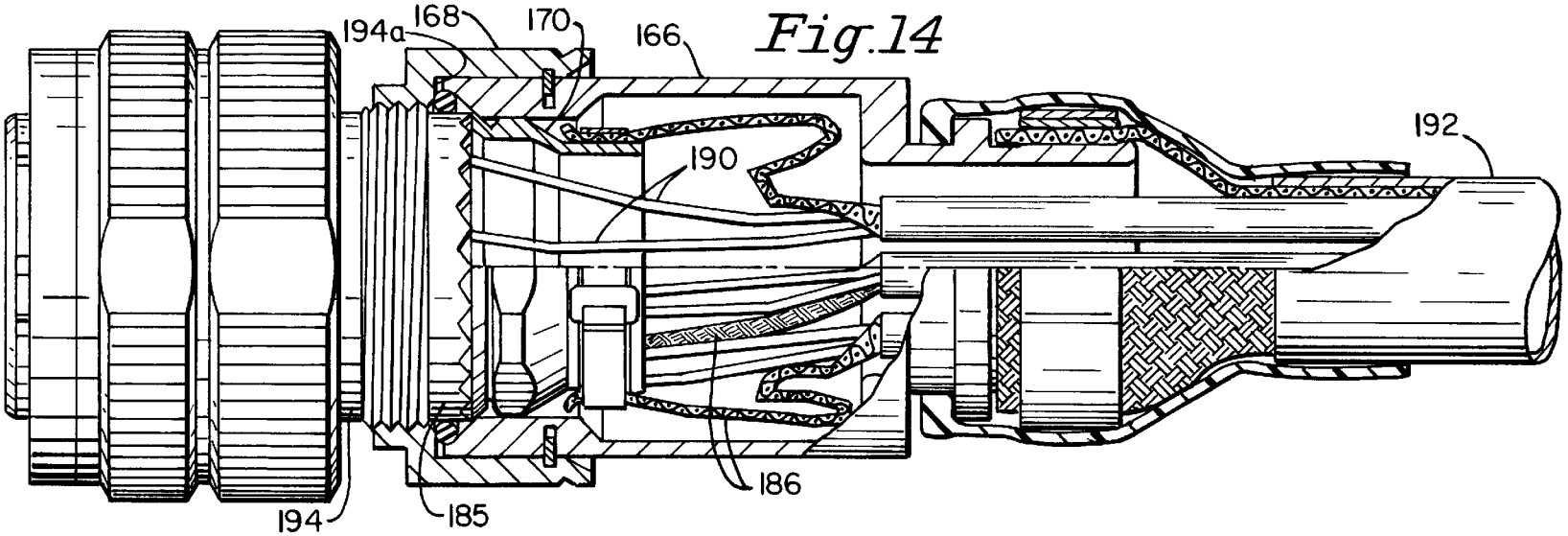
FIG. 14 illustrates the assembled multipin connector, yoke and backshell connector.

The position of the elements in FIG. 13 illustrates the structure prior to complete assembly and the disassembled arrangement during repair. In other words by unscrewing the backshell adapter from the multipin connector the interior of the assembly specifically the yoke, braids, conductors and back of the multipin connector are exposed. When assembled, see FIG. 14 however, the yoke is grounded to the connector's, meshing teeth, and the leads lie within the conductive and grounded yoke and thus are protected from electric fields and EMI.

Figure 16:
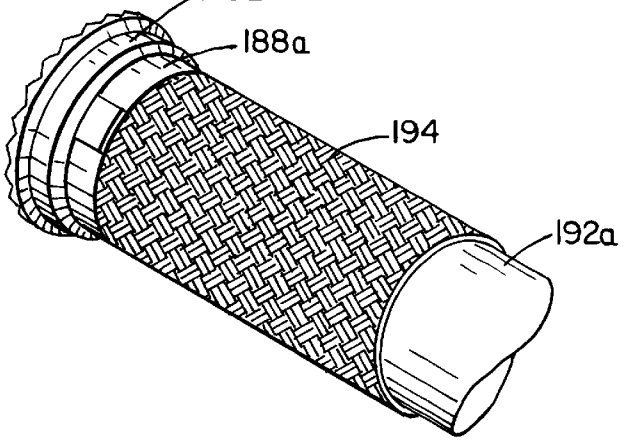
FIG. 16 illustrates the outer cable shielding braid secured to the yoke.

To provide complete protection of the information leads 190, braids, etc., shield 194 of the cable 192 may be brought forward and be connected to the yoke by strap 188 this providing complete shielding of all elements all the way to the multipin connector. Such an arrangement is illustrated in FIG. 16.

As previously noted environmental sealing of the assembly is provided by the interface of O-ring 182 with a shoulder on the connector 194*a*.

Figure 15:
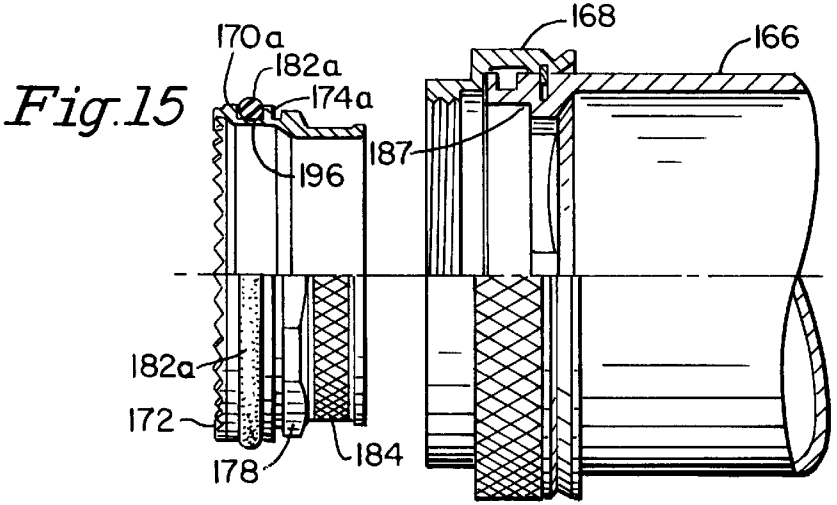
FIG. 15 illustrates an alternative arrangement and the moisture proof seal of the yoke and backshell connection.

Alternatively and reference is made to FIG. 15, the assembly may be sealed by an O-ring 182*a* located in a groove 196 in an outer surface of a yoke 170*a*. When the yoke is seated in the backshell adapter a surface 198 of the adapter 166 compresses the O-ring to provide the desired seal.

Once given the above disclosure, many other features, modifications and improvements will become apparent to the skilled artisan. Such features, modifications and improvements are, therefore, considered to be a part of this invention, the scope of which is to be determined by the following claims.

What is claimed is:

1. A multiple internal shield termination system for terminating individual shields of a cable containing multiple shielded conductors comprising:

a conductive yoke in the form of an annulus with a front end and a back end, said conductive yoke configured to have the back end removably insertable into a front end of a transitional element and wherein said yoke further provides a region between the ends of the yoke providing a relatively constant outer diameter surface;

low resistance means for individually connecting shields of the shielded conductors to said yoke;

a first surface of the yoke adjacent said back end generally perpendicular to its axis and the axis of the cable on said yoke for providing a low loss electrical path between the shields and a reference potential;

a plurality of first holes extending into said first surface in an arcuate path along said first surface for receiving said low resistance means;

a plurality of radial holes extending through said constant outer diameter surface and intersecting said first holes in said first surface, wherein said low resistance means is adapted to have solder wires inserted into said radial holes; and a plurality of leads each disposed in at least one of the first holes on said first surface.

2. A multiple internal shield termination system according to claim 1 wherein said low resistance means comprises:

a second surface of said yoke at the front end thereof at a sharp angle to the axis of said yoke;

a plurality of holes formed in said second surface.

3. A multiple internal shield termination system according to claim 1 wherein said low resistance means comprises:

a conductive tape having a plurality of electrical leads connected thereto in spaced relation along the length of the tape;

said tape conductively secured to said constant diameter outer surface.

4. A multiple internal shield termination system according to claim 3 wherein said tape is secured to said constant diameter outer surface by a strap.

5. A multiple internal shield termination system according to claim 3 wherein said tape is secured to said constant diameter outer surface by a fusable conductive material.

6. A multiple internal shield termination system comprising:

a backshell adapter having a centrally located axially extending passage, a front end and a back end;

an annular electrically conductive yoke having a front end and a back end, said yoke configured to have said back end fit into said front end of said backshell adapter with the front end of said yoke protruding therefrom;

a multiconductor cable having a plurality of conductors and grounding leads shielding said conductors; and means for securing said grounding leads to said yoke;

means for physically connecting said multiconductor cable to said back end of said backshell adapter, said grounding leads extending from said cable into said backshell adapter;

means for connecting said grounding leads to said yoke; and means for physically coupling said backshell adapter to a multipin electrical connector with said yoke in direct electrical and physical contact with the electrical connector.

7. An adapter assembly for electrical cable having an external shield and a connector comprising:

a cylindrical body having a first end;

a first collar rotatably mounted on said body;

a detachable cylindrical yoke contained within said first end of said body, said yoke having at a first end a means for interfacing with a suitably designed electrical connector to retain said yoke in said body, and at a second end a means for securing an electrical ground, wherein said yoke has a rearward circular extension for encircling with the external shield of the cable with which said adapter assembly is to be employed; and a seal located between said yoke and said body, said seal comprising an O-ring, wherein said body is fabricated from corrosion resistant stainless steel and said yoke is fabricated from a material which is more electrically conductive stainless steel.

8. The adapter assembly of claim 7 wherein said yoke and said body have interacting means to prevent rotation of one with respect to the other.

9. The adapter assembly of claim 7 further comprising:

means for sealing the interior of the adapter assembly, said means including a sealing member located on said body in a position to engage a surface on the electrical connector.

* * * * *